US008041496B2

(12) United States Patent
Eser et al.

(10) Patent No.: US 8,041,496 B2
(45) Date of Patent: Oct. 18, 2011

(54) METHOD AND DEVICE FOR CHECKING THE OPERABILITY OF A TANK VENTING DEVICE FOR AN INTERNAL COMBUSTION ENGINE

(75) Inventors: Gerhard Eser, Hemau (DE); Wolfgang Mai, Kronberg (DE); Jens Pache, Kaufungen (DE)

(73) Assignee: Continental Automotive GmbH, Hannover (DE)

( * ) Notice: Subject to any disclaimer, the term of this patent is extended or adjusted under 35 U.S.C. 154(b) by 455 days.

(21) Appl. No.: 12/361,601

(22) Filed: Jan. 29, 2009

(65) Prior Publication Data

US 2009/0204309 A1 Aug. 13, 2009

(51) Int. Cl.
*F02D 45/00* (2006.01)
*F02M 25/08* (2006.01)

(52) U.S. Cl. ..... 701/102; 123/520

(58) Field of Classification Search ..... 701/102, 701/103–105; 123/516, 518, 519, 520; 73/114.39
See application file for complete search history.

(56) References Cited

U.S. PATENT DOCUMENTS 5,056,494 A 10/1991 Kayanuma ..... 123/519
5,273,018 A * 12/1993 Suzuki ..... 123/520
5,389,245 A * 2/1995 Jaeger et al. ..... 123/516
6,739,310 B2 5/2004 Esteghal et al. ..... 123/295
2010/0031932 A1* 2/2010 Mai et al. ..... 123/520

FOREIGN PATENT DOCUMENTS

DE 19836102 C2 4/2003
DE 102005054880 B3 6/2007
EP 1317617 B1 2/2006

* cited by examiner

*Primary Examiner* — Hieu T Vo

(74) *Attorney, Agent, or Firm* — King & Spalding L.L.P.

(57) ABSTRACT

The tank venting device has a fuel vapor reservoir connected to a fuel tank to deliver escaping fuel vapors to the fuel vapor reservoir, and is connected to the internal combustion engine in such a manner that during a tank venting operation the fuel vapors contained in the fuel vapor reservoir are delivered as regeneration gas. To check the operability of the venting device the fuel concentration in the regeneration gas is ascertained at a minimum of two different points in time during the venting operation. The fuel concentration values in the regeneration gas are compared with respective reference values representing the regeneration gas fuel concentration in the situation in which no additional fuel vapors are delivered during the venting operation. The assessment of the venting device operability is carried out by comparison of the values ascertained for the fuel concentration in the regeneration gas with the reference values.

20 Claims, 2 Drawing Sheets

METHOD AND DEVICE FOR CHECKING THE OPERABILITY OF A TANK VENTING DEVICE FOR AN INTERNAL COMBUSTION ENGINE

CROSS-REFERENCE TO RELATED APPLICATIONS

This application claims priority to DE Patent Application No. 10 2008 007 030.0 filed Jan. 31, 2008, the contents of which is incorporated herein by reference in its entirety.

TECHNICAL FIELD

The invention relates to a method and a device for checking the operability of a tank venting device for an internal combustion engine, in particular for detecting a blocked connecting pipe between a fuel vapor reservoir of the tank venting device and the fuel tank.

BACKGROUND

In order to comply with statutory emission limit values, modern motor vehicles have a tank venting device. The main part of the tank venting device is a fuel vapor reservoir which is preferably designed as an activated carbon canister. The fuel vapors contained in the fuel tank are delivered by way of a connecting pipe to the activated carbon canister where they are absorbed by the activated carbon and stored in this manner. The activated carbon canister needs to be regenerated from time to time. To this end, the fuel vapor reservoir is connected by way of a tank venting pipe and a tank venting valve arranged therein to the induction manifold of the internal combustion engine of the motor vehicle. The absorbed fuel vapors are drawn into the intake tract of the internal combustion engine on account of the vacuum prevailing in the induction manifold and then participate in the combustion process together with the fresh air. In this manner, the emission of fuel vapors from the fuel tank into the environment is reliably avoided.

Increasingly stringent legislation stipulates that the operability of the tank venting device must be checked. A method is thus known for example from DE 10 2005 054 880 B3 for checking the integrity of the tank venting device, according to which the tank venting device is initially evacuated by means of the induction manifold vacuum and the integrity of the tank venting device is checked by evaluating the pressure profile therein.

In addition, a method is known from DE 198 36 102 C2 for validating a tank pressure sensor.

SUMMARY

According to various embodiments, a method and a device can be created by means of which additional checking of the operability of the tank venting device is possible.

According to an embodiment, a method for checking the operability of a tank venting device for an internal combustion engine, wherein the tank venting device has a fuel vapor reservoir which is connected to a fuel tank of the internal combustion engine in such a manner that fuel vapors escaping from there are delivered to the fuel vapor reservoir, and which is connected to the internal combustion engine in such a manner that during a tank venting operation the fuel vapors contained in the fuel vapor reservoir are delivered to the internal combustion engine as regeneration gas, may comprise the steps of: ascertaining the fuel concentration in the regeneration gas at a minimum of two different points in time during the tank venting operation, comparing the values ascertained for the fuel concentration in the regeneration gas with reference values assigned in each case, wherein the reference values represent the fuel concentration in the regeneration gas for the situation in which no additional fuel vapors are delivered to the fuel vapor reservoir during the tank venting operation, and carrying out an assessment of the operability of the tank venting device on the basis of the comparison of the values ascertained for the fuel concentration in the regeneration gas with the reference values.

According to a further embodiment, the tank venting device may be considered to be faulty if the values ascertained for the fuel concentration in the regeneration gas are of equal magnitude to the reference values assigned in each case or if the values ascertained for the fuel concentration in the regeneration gas differ by less than a predefined difference from the reference values assigned in each case. According to a further embodiment, the reference values form value groups and each of the value groups may be assigned to a particular initial fuel concentration in the regeneration gas. According to a further embodiment, the value group of reference values to be used for the comparison may be determined depending on the value first ascertained during the tank venting operation for the fuel concentration in the regeneration gas. According to a further embodiment, the reference values can be saved depending on a regeneration gas quantity which is delivered during the tank venting operation of the internal combustion engine. According to a further embodiment, the regeneration gas quantity which is delivered to the internal combustion engine during the tank venting operation can be ascertained, and the values ascertained for the fuel concentration in the regeneration gas with regard to the respective regeneration gas quantity can be compared with corresponding reference values for the same respective regeneration gas quantity in each case. According to a further embodiment, the assessment of the operability of the tank venting device can be carried out only in the situation when a temperature which is a measure of the temperature in the fuel tank exceeds a predefined limit value. According to a further embodiment, the assessment of the operability of the tank venting device may be carried out only in the situation when the fuel tank has a predefined minimum fill quantity. According to a further embodiment, the assessment of the operability of the tank venting device may be carried out only in the situation when the fuel fill quantity in the fuel tank falls below a predefined maximum fill quantity. According to a further embodiment, the tank venting device may be considered to be at least partially operational if the fuel concentration in the regeneration gas initially ascertained during the tank venting operation is less than the fuel concentration in the regeneration gas initially ascertained during a subsequent tank venting operation with regard to the same delivered quantity of regeneration gas in each case. According to a further embodiment, a fuelling operation of the fuel tank may have taken place between the tank venting operation and the following tank venting operation.

According to another embodiment, a control device for an internal combustion engine may comprise a tank venting device, wherein the tank venting device has a fuel vapor reservoir which is connected to a fuel tank of the internal combustion engine in such a manner that fuel vapors escaping from there are delivered to the fuel vapor reservoir, and which is connected to the internal combustion engine in such a manner that during a tank venting operation the fuel vapors contained in the fuel vapor reservoir are delivered to the internal combustion engine as regeneration gas, wherein in order to check the operability of the tank venting device, the control device is operable to: ascertain the fuel concentration in the regeneration gas at a minimum of two different points in time during the tank venting operation, compare the values ascertained for the fuel concentration in the regeneration gas with reference values assigned in each case, wherein the reference values represent the fuel concentration in the regeneration gas for the situation in which no additional fuel vapors are delivered to the fuel vapor reservoir during the tank venting operation, and to carry out an assessment of the basis of the comparison of the values ascertained for the fuel concentration in the regeneration gas with the reference values.

BRIEF DESCRIPTION OF THE DRAWINGS

An embodiment of the invention will be described in detail in the following with reference to the accompanying figures. In the figures.

DETAILED DESCRIPTION

Figure 1:
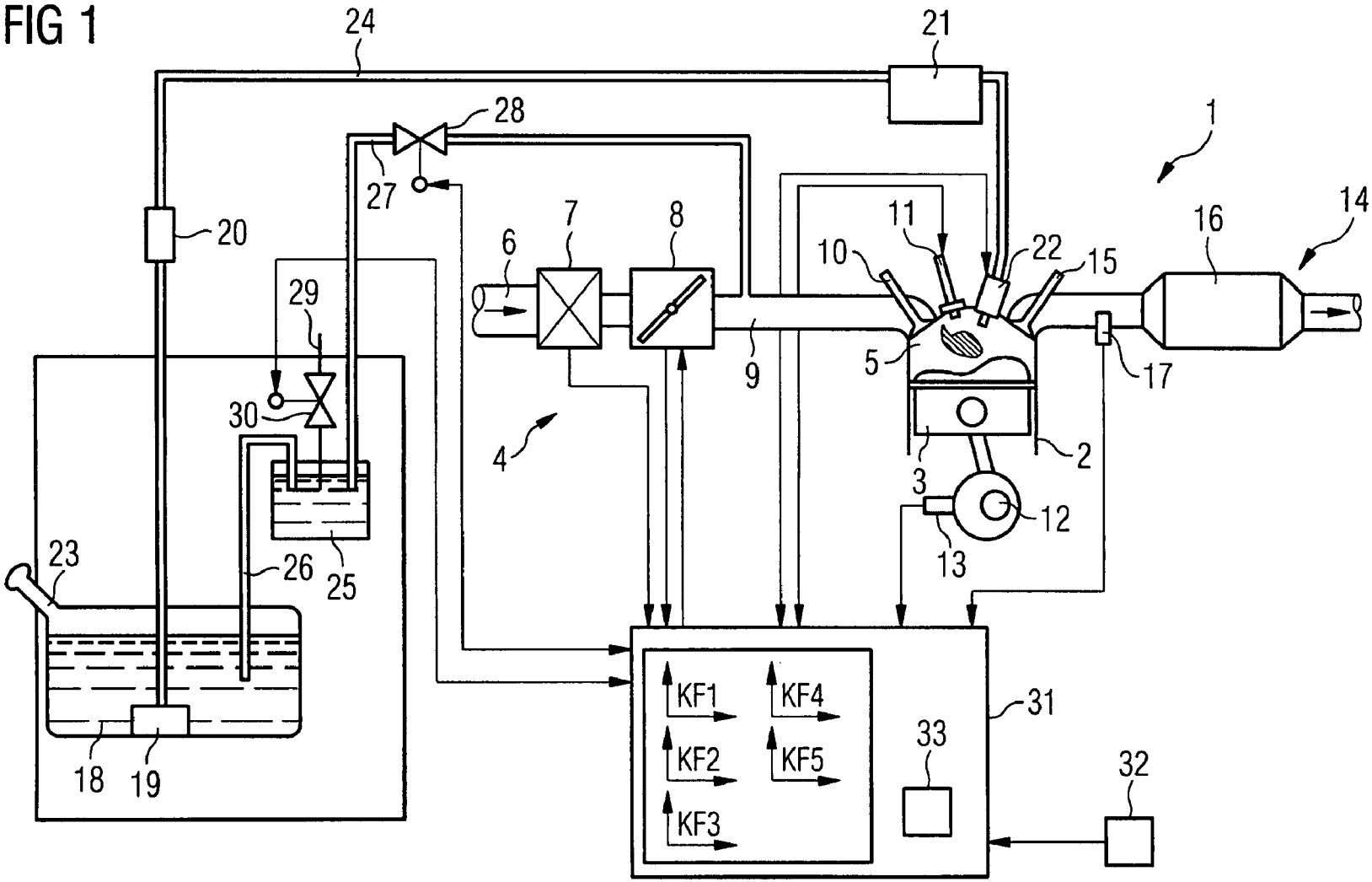
FIG. 1 shows a schematic representation of an internal combustion engine with an associated tank venting device.

The method according to an embodiment is used for checking the operability of a tank venting device for an internal combustion engine, whereby the tank venting device has a fuel vapor reservoir which is connected to a fuel tank of the internal combustion engine in such a manner that fuel vapors escaping from there are delivered to the fuel vapor reservoir. The fuel vapor reservoir is also connected to an intake tract of the internal combustion engine in such a manner that during a tank venting operation the fuel vapors contained in the fuel vapor reservoir are directed into the intake tract as regeneration gas. According to the method, the fuel concentration in the regeneration gas is ascertained at a minimum of two different points in time during the tank venting operation. The values ascertained for the fuel concentration in the regeneration gas are compared with reference values assigned in each case, whereby the reference values represent the fuel concentration in the regeneration gas for the situation in which no additional fuel vapors are delivered to the fuel vapor reservoir during the tank venting operation. The assessment of the operability of the tank venting device is then carried out on the basis of the comparison of the values ascertained for the fuel concentration in the regeneration gas with the reference values assigned in each case.

This method permits additional checking of the operability of the tank venting device. In particular, it is possible to check whether there is a defect in the connecting pipe between the fuel tank and the fuel vapor reservoir. Possible conceivable defects are a blockage or leak in the connecting pipe. The various embodiments are based on the idea that in the case of an intact connecting pipe the values ascertained for the fuel concentration in the regeneration gas differ noticeably from reference values because the fuel vapor reservoir is permanently charged with fuel vapors. In this situation, the reference values can be obtained by means of appropriate test runs in a laboratory.

In an embodiment of the method, the tank venting device is considered to be faulty if the values ascertained for the fuel concentration in the regeneration gas are of equal magnitude to the reference values assigned in each case or if the values ascertained for the fuel concentration in the regeneration gas differ by less than a predefined difference from the reference values assigned in each case.

This embodiment is based on the idea that in the case of an intact tank venting device and under normal circumstances fuel vapors evaporating from the fuel tank are continually passed on to the fuel vapor reservoir. The fact that the activated carbon is also constantly charged with new hydrocarbons during the tank venting operation naturally has effects on the composition of the regeneration gas: In the case of an operational tank venting device the actual distribution of the concentration of hydrocarbons in the regeneration gas always differs considerably from the distribution predefined by the reference values because the latter represent the fuel concentration in the regeneration gas for the situation in which no additional fuel vapors are delivered to the fuel vapor reservoir during the tank venting operation. In this respect the tank venting device is to be considered faulty if the values ascertained for the fuel concentration in the regeneration gas are of equal magnitude to the reference values assigned in each case or if the values ascertained for the fuel concentration in the regeneration gas differ by less than a predefined difference from the reference values assigned in each case. Possible conceivable faults are a blockage or a leak, for example.

In an embodiment of the method, the reference values form value groups, whereby each of the value groups is assigned to a particular initial fuel concentration in the regeneration gas.

In an embodiment of the method, the value group of reference values to be used for the comparison is determined depending on the first value ascertained for the fuel concentration in the regeneration gas.

Since the regeneration of the fuel vapor reservoir is carried out during vehicle operation on the basis of different charging states of the fuel vapor reservoir, the (initial) fuel concentration in the regeneration gas must first be ascertained. This advantageously happens directly at the beginning of the tank venting operation. Using this initial fuel concentration, or initial charge, it is then possible to ascertain the corresponding value group of reference values for the same initial fuel concentration and use this as the basis for a comparison. In this situation, the value groups of reference values can be determined experimentally in the laboratory by means of corresponding test runs, during which the distribution of the concentration of hydrocarbons in the regeneration gas during a tank venting operation is ascertained on the basis of different initial fuel concentrations.

In an embodiment of the method, the reference values are saved depending on a regeneration gas quantity which is delivered during the tank venting operation of the internal combustion engine.

In an embodiment of the method, the regeneration gas quantity which is delivered to the internal combustion engine during the tank venting operation is ascertained. The values ascertained for the fuel concentration in the regeneration gas with regard to the respective regeneration gas quantity are compared with corresponding reference values for the same respective regeneration gas quantity.

As a result of these embodiments of the method an unambiguous correlation between the reference values and the values ascertained for the fuel concentration in the regeneration gas is guaranteed. In addition, in this manner the comparability of the reference values with the values ascertained for the fuel concentration is ensured even in the case of changing flushing rates. In this situation, the determination of the reference values can be carried out in the laboratory at constant flushing rates, or regeneration gas quantity flows.

This serves to ensure that a corresponding, comparable reference value is present for each value ascertained for the fuel concentration in the regeneration gas.

In an embodiment of the method, the operability of the tank venting device is assessed only in the situation when a temperature which is a measure of the temperature in the fuel tank exceeds a predefined limit value.

In an embodiment of the method, the assessment of the operability of the tank venting device is carried out only in the situation when the fuel tank has a predefined minimum fill quantity.

According to the embodiment, the assessment of the operability of the tank venting device is carried out only in the situation when the fuel fill quantity in the fuel tank falls below a predefined maximum fill quantity.

The temperature in the fuel tank and the fill level of fuel have a direct influence on the tendency of the fuel in the fuel tank to evaporate. A greater tendency of the fuel in the fuel tank to evaporate results in a more conspicuous difference between the values ascertained for the fuel concentration in the regeneration gas and the reference values assigned in each case. This has to do with the fact that the fuel vapor reservoir is repeatedly charged with fuel vapors from the fuel tank during the tank venting operation. These embodiments of the method therefore permit a more reliable assessment of the operability of the tank venting device.

In an embodiment of the method, the tank venting device is considered to be at least partially operational if the fuel concentration in the regeneration gas initially ascertained during the tank venting operation is less than the fuel concentration in the regeneration gas initially ascertained during a subsequent tank venting operation, the delivered quantity of regeneration gas being the same in each case.

The reason for this is that in the event of a rise in the initially measured fuel concentration with regard to two tank venting operations carried out in succession for the same quantity of regeneration gas delivered in each case it is assumed that the fuel vapor reservoir has been recharged with fuel vapors in the meantime. For this reason, the tank venting device can be considered to be at least partially operational inasmuch as the connecting pipe between fuel tank and fuel vapor reservoir is neither blocked nor leaking.

Through an embodiment of the method, it is possible to further improve the embodiment of the method as claimed in claim 10 insofar as a fuelling operation of the fuel tank has taken place between the tank venting operation and the following tank venting operation.

As a result of the fuelling operation, the tendency of the fuel to evaporate is increased on account of the agitation of the fuel and the greater quantity of fuel in the tank. If therefore a fuelling operation has taken place between the tank venting operations, then it is to be assumed that with regard to a fully operational tank venting device the initial fuel concentration in the case of the tank venting operation carried out after the fuelling operation is greater than the initial fuel concentration in the case of the tank venting operation carried out before the fuelling operation. In this manner, the assessment of the operability of the tank venting device can be configured yet more reliably.

The control device, can be designed in order to execute the method as described above. For the advantages which such a control device offers, reference is made to the explanations for the method.

FIG. 1 shows an embodiment of an internal combustion engine 1. The internal combustion engine 1 has at least one cylinder 2 and a piston 3 which moves in the cylinder 2. The fresh air required for the combustion is introduced by way of an intake tract 4 into a combustion chamber 5 delimited by the cylinder 2 and the piston 3. Downstream of an intake port 6 in the intake tract 4 is situated an air mass sensor 7 for detecting the air flow rate in the intake tract 4, a throttle valve 8 for controlling the air flow rate, an induction manifold 9 and an inlet valve 10, by means of which the combustion chamber 5 is optionally connected to or disconnected from the intake tract 4.

The ignition of the combustible mixture is effected by means of a spark plug 11. The drive energy generated by the combustion is transferred by way of a crankshaft 12 to the drive train of the motor vehicle (not shown). A rotational speed sensor 13 detects the rotational speed of the internal combustion engine 1.

The combustion gases are discharged by way of an exhaust tract 14 from the internal combustion engine 1. The combustion chamber 5 is optionally connected to or disconnected from the intake tract 4 by means of an outlet valve 15. The exhaust gases are cleaned in an exhaust gas cleaning catalytic converter 16. Also located in the exhaust tract 14 is a so-called lambda sensor 17 for measuring the oxygen content in the exhaust gas. With regard to the lambda sensor 17, in this situation it can be both a binary lambda sensor 17 and also a linear lambda sensor 17.

The internal combustion engine 1 also includes a fuel supply facility comprising a fuel tank 18, a fuel pump 19, a high-pressure pump 20, a pressure reservoir 21 and at least one controllable injection valve 22 per cylinder 2. The fuel tank 18 has a sealable filler neck 23 for fuel filling. The fuel is carried by means of the fuel pump 19 into a fuel supply line 24. In the fuel supply line 24 are arranged the high-pressure pump 20 and the pressure reservoir 21. The high-pressure pump 20 has the function of delivering the fuel at high pressure to the pressure reservoir 21. In this situation, the pressure reservoir 21 is designed as a common pressure reservoir 21 for all the injection valves 22. From this, all the injection valves 22 are supplied with pressurized fuel. The exemplary embodiment concerns an internal combustion engine 1 with direct fuel injection, in which the fuel is injected directly into the combustion chamber 5 by means of the injection valve 22 projecting into the combustion chamber 5. It should however be noted that the present invention is not restricted to this type of fuel injection but can also be applied to other types of fuel injection, such as induction manifold injection for example.

In addition, the internal combustion engine 1 has a tank venting device. Part of the tank venting device is formed by a fuel vapor reservoir 25 which for example is designed as an activated carbon canister and is connected by way of a connecting pipe 26 to the fuel tank 18. The fuel vapors arising in the fuel tank 18 are continuously fed into the fuel vapor reservoir 25 by way of the connecting pipe 26 and adsorbed there by the activated carbon. The fuel vapor reservoir 25 is connected by way of a venting pipe 27 to the induction manifold 9 of the internal combustion engine 1. A controllable tank venting valve 28 is arranged in the venting pipe 27. The flow rate at the tank venting valve can be set for example by means of a pulse width modulated signal (PWM signal). In addition, the fuel vapor reservoir 25 is connected by way of an aeration pipe 29 and a controllable aeration valve 30 arranged therein with the ambient environment such that fresh air can be delivered to the fuel vapor reservoir.

In certain operating areas of the internal combustion engine 1, in particular when idling or under partial load, as a result of the strong choke effect caused by the throttle valve 8 a large pressure gradient prevails between the ambient environment and the induction manifold 9. During a tank venting operation, in which the tank venting valve 28 and the aeration valve 30 are open, a flushing effect therefore occurs in which the fuel vapors stored in the fuel vapor reservoir 25 are directed as regeneration gas into the intake tract, or the induction manifold 9, where they mix with the intake air and participate together with the intake air in the combustion in the combustion chambers 5. The fuel vapors, or the regeneration gas, cause a change in the composition of the combustible mixture and of the exhaust gases. At the same time, fresh air flows into the fuel vapor reservoir 25 by way of the aeration pipe 29. New fuel vapors are also always flowing from the fuel tank 18 into the fuel vapor reservoir 25 during the tank venting operation.

The internal combustion engine 1 has associated with it a control device 31 in which are implemented characteristic field based engine control functions (KF1 to KF5). The control device 31 is connected with all actuators and sensors of the internal combustion engine 1 by way of signal and data lines. In particular, the control device 31 is connected with the aeration valve 30, the tank venting valve 28, the air mass sensor 7, the throttle valve 8, the injection valve 22, the spark plug 11, the lambda sensor 17 and the rotational speed sensor 13.

Parts of the internal combustion engine 1 and of the control device 31 form a lambda regulation facility. The lambda regulation facility comprises in particular the lambda sensor 17, a lambda regulator 33 implemented by software in the control device 31, as well as the injection valves 22 and their drive mechanism with which the opening times of the injection valves 22 and thus the metered fuel quantity are controlled. The lambda regulation facility forms a closed lambda regulation circuit and is configured in such a manner that any deviation in the exhaust gas composition from the predefined lambda nominal value detected by the lambda sensor 17 is corrected. If the tank venting valve 28 is opened during the tank venting operation, then as a result of the pressure gradient fuel vapors flow from the fuel vapor reservoir 25 into the intake tract 4, or the induction manifold 9, of the internal combustion engine 1. These fuel vapors, whose concentration in the intake air is initially unknown, result in a change in the combustible mixture, in other words in a changed quantity of hydrocarbons in the combustion gas and, after combustion has taken place, in a corresponding change in the exhaust gas composition. As a result, the lambda value measured by the lambda sensor 17 deviates from the nominal value (lambda=1 for example). A deviation from the norm thus occurs which is registered by the lambda regulator 33 and is compensated for by a corresponding change in the regulator output variable. This is done by specifying a corresponding correcting variable for the injection valves 22, as a result of which the injected fuel quantity is changed accordingly until the fault is corrected. This process is referred to as injection quantity correction.

By using the lambda regulation facility it is possible to ascertain the fuel concentration in the regeneration gas. To this end, the initially closed tank venting valve 28 is opened by means of a corresponding pulse width modulated signal and is controlled in such a manner that a small but defined regeneration gas quantity flow $\dot{m}$ flows through the tank venting valve. The change in the combustible mixture caused by this also results in a change in the exhaust gas composition which is registered by the lambda sensor 17, or the lambda regulator 33. The opening of the tank venting valve 28 results in a deviation from the initial value for the lambda regulator 33, or the lambda sensor 17, compared with the point in time prior to opening of the tank venting valve 28. The initial value for the lambda regulator 33, or alternatively for the lambda sensor 17, prior to opening of the tank venting valve 28 is referred to in the following as base initial value. The difference ΔLAMBDA between the initial value for the lambda regulator 33, or the lambda sensor 17, after opening of the tank venting valve and the base initial value represents a measure of the fuel quantity additionally delivered by the regeneration gas. With a knowledge of the regeneration gas quantity flow $\dot{m}$ at the tank venting valve it is possible to calculate the fuel concentration $C_{Fuel}$ in the regeneration gas:

$$C_{Fuel} = \frac{\Delta LAMBDA}{\dot{m}} xK \qquad \text{(Equation 1)}$$

where K is a conversion constant.

Figure 2:
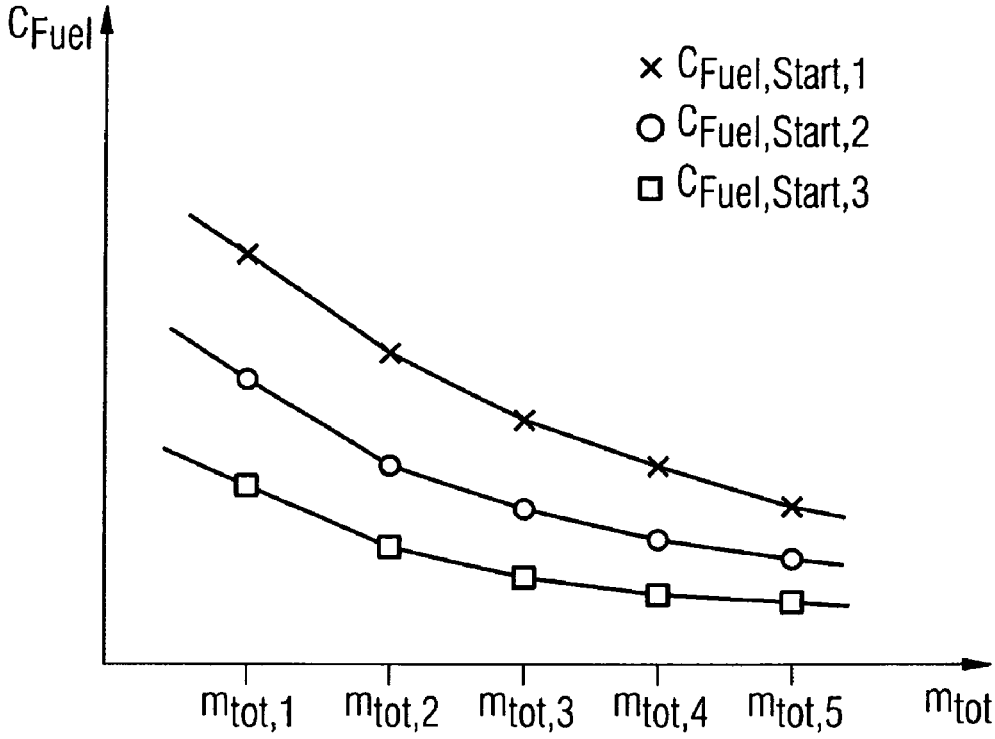
FIG. 2 shows a diagram in which reference values for the fuel concentration in the regeneration gas flow are represented against the regeneration gas quantity flow.

Reference values are stored in the control device for the fuel concentration $C_{Fuel}$ in the regeneration gas, depending on the regeneration gas quantity $m_{tot}$ delivered since the beginning of the tank venting operation, in other words since opening of the tank venting valve. In this situation, the reference values reflect the fuel concentration $C_{Fuel}$ in the regeneration gas which results if the fuel vapor reservoir 25 is not additionally charged anew with fuel vapors during the tank venting operation. In this situation, the reference values are combined in the form of value groups, depending on an initial fuel concentration $C_{Fuel,Start}$ which is present immediately on opening the tank venting valve 28. The reference values in a value group therefore represent the progression of the fuel concentration $C_{Fuel}$ in the regeneration gas starting from a certain initial fuel concentration $C_{Fuel,start}$ during the tank venting operation. The reference values can be obtained for example by means of a simple test arrangement and corresponding test runs in the laboratory. For example, it is possible to connect the fuel vapor reservoir by way of a venting pipe to a corresponding vacuum source (a vacuum pump for example) which replaces the induction manifold of the internal combustion engine as the vacuum source. In the venting pipe are arranged a controllable valve and a flow meter with which the regeneration gas quantity flow can be set and the regeneration gas quantity measured. The fuel vapor reservoir must furthermore be connected by way of an aeration pipe with the ambient environment such that a flushing flow and pressure equalization arise with regard to the simulated tank venting operation. The regeneration gas quantity flow is totaled from the beginning of the flushing operation. In addition, the fuel concentration $C_{Fuel}$ in the regeneration gas is ascertained at regular intervals, in other words in the case of certain values for the delivered regeneration gas quantity $m_{tot,1}$ to $m_{tot,5}$ (see FIG. 2). The fuel concentration $C_{Fuel}$ in the regeneration gas flow immediately after the beginning of the flushing operation produces the initial fuel concentration $C_{Fuel,Start}$. Test runs are carried out for a plurality of different initial fuel concentrations $C_{Fuel,Start1}$ to $C_{Fuel,Start3}$, which can be achieved simply by different initial charging of the activated carbon canister with fuel vapors. If these values are depicted in the form of a diagram, the result is a representation according to FIG. 2. Although actual measured values for the fuel concentration in the regeneration gas are available only for the $m_{tot,1}$ to $m_{tot,5}$ sampling points and for the initial fuel concentrations $C_{Fuel,Start1}$ to $C_{Fuel,Start3}$, intermediate values can however be calculated through interpolation.

An embodiment of a method for checking the operability of the tank venting device will be described in detail in the following.

If a tank venting operation is to be performed in order to regenerate the fuel vapor reservoir 25, then a suitable operating state of the internal combustion engine 1, idling or the lower partial load range for example, is awaited in which an adequate vacuum prevails in the induction manifold 9. When suitable operating conditions exist, then the tank venting operation is commenced by opening the tank venting valve 28. After the tank venting valve 28 has been opened, the delivered regeneration gas quantity $m_{tot}$ which flows through the tank venting valve 28 is measured. Since the tank venting valve 28 in question is preferably an electrically operated valve whose flow rate can be controlled precisely by means of a PWM signal, the regeneration gas quantity can be ascertained in a simple manner with a knowledge of the clock rate of the tank venting valve 28.

After the tank venting valve 28 and the aeration valve 29 have been opened, the fuel vapors stored in the fuel vapor reservoir 25 flow by way of the venting pipe 27 into the induction manifold 9 of the internal combustion engine 1, are mixed there with the intake fresh air, flow together with the latter into the combustion chambers 5 of the internal combustion engine 1 and participate there in the combustion process. As a result, a change occurs in the combustible mixture composition and consequently a change in the exhaust gas composition, which is recognized as a fault by the lambda sensor 17. Thereupon the lambda regulator 33 carries out a corresponding correction of the fuel quantity delivered by way of the injection valves 22 in order to adjust the composition of the combustible mixture or of the exhaust gas back to a correspondingly predefined nominal value. With a knowledge of the regulator initial value ΔLAMBDA or of the correction value for the injected fuel quantity, which ultimately corresponds to the fuel quantity delivered by way of the regeneration gas, and the regeneration gas quantity flow flowing by way of the tank venting valve 28, it is possible to deduce the fuel concentration $C_{Fuel}$ in the regeneration gas in accordance with equation 1.

Measurements are now carried out at a minimum of two, advantageously however at a plurality of, different points in time in order to assess the operability of the tank venting device. In this situation, at each point in time there results a particular fuel concentration $C_{Fuel}$ in the regeneration gas and a particular delivered regeneration gas quantity $m_{tot}$ which are unambiguously assigned to one another. The first measured particular fuel quantity concentration $C_{Fuel}$ in the regeneration gas, which is assigned to a particular regeneration gas quantity $m_{tot}$, is advantageously used in order to select a comparable value group of reference values as the comparison basis. To this end, in the characteristic field in which the value groups of reference values are stored the value group is used which exhibits the value ascertained for the fuel concentration $C_{Fuel}$ in the regeneration gas for the same overall regeneration gas quantity. This value group of reference values is then used as the comparison basis for checking the operability of the tank venting device. Since the value groups in the characteristic field (see FIG. 2) have discrete reference values it can happen that none of the reference values stored therein corresponds to the ascertained fuel concentration $C_{Fuel}$ in the regeneration gas. For this reason, it is possible to determine an appropriate value group of reference values by means of interpolation between the stored discrete value groups and then use it as the comparison basis.

Figure 3:
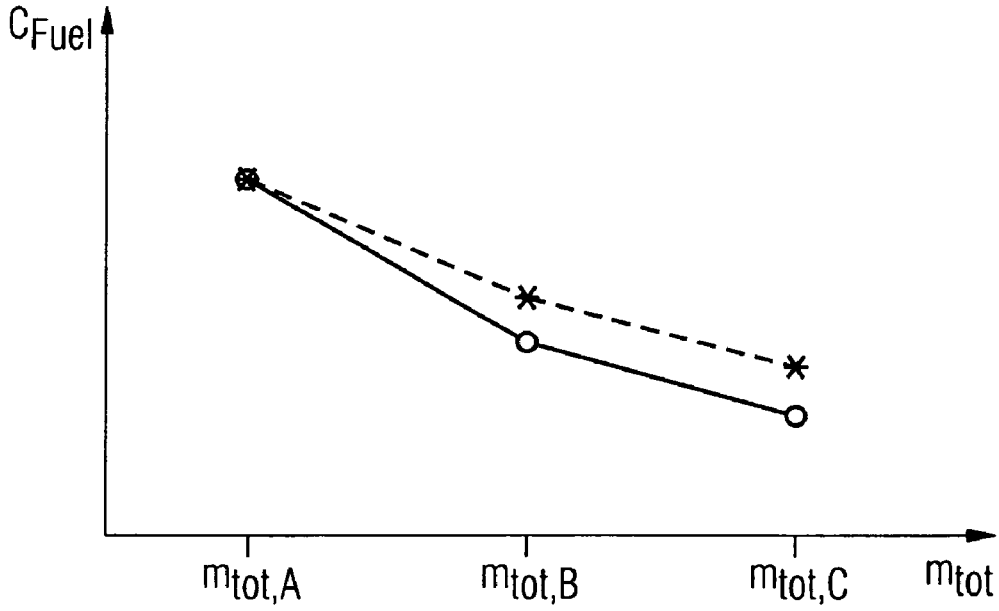
FIG. 3 shows a diagram in which the reference values for the fuel concentration are represented against the regeneration gas quantity flow in comparison with the concentration values actually ascertained during a tank venting operation.

In FIG. 3, the fuel concentration $C_{Fuel}$ in the regeneration gas is illustrated in a diagram against the regeneration gas quantity $m_{tot}$. The values actually ascertained during the tank venting operation for the fuel concentration $C_{Fuel}$ in the regeneration gas are represented here as crosses. They represent the progression, identified by a dashed line, of the fuel concentration $C_{Fuel}$ in the regeneration gas during the tank venting operation. On account of the flushing operation in the fuel vapor reservoir 25 and the regeneration of the activated carbon caused by this the fuel concentration $C_{Fuel}$ in the regeneration gas decreases during the course of the tank venting operation, in other words as the regeneration gas quantity $m_{tot}$ increases.

In FIG. 3, the reference values assigned to the corresponding value group are drawn as circles. They represent the progression, identified by a solid line, of the fuel concentration $C_{Fuel}$ in the regeneration gas during a tank venting operation for the situation in which the fuel vapor reservoir 25 is regenerated without additional delivery of or charging with fuel vapors.

As can be seen from FIG. 3, the fuel concentration $C_{Fuel}$ in the regeneration gas decreases more slowly in the case of the dashed line than in the case of the solid line (reference values). This can be explained by the fact that as a rule fuel vapors flow during the tank venting operation from the fuel tank 18 by way of the connecting pipe 26 into the fuel vapor reservoir 25 and continuously charge the latter with additional fuel vapors. By contrast, no additional charging of the fuel vapor reservoir 25 takes place during determination of the reference value, for which reason the fuel concentration $C_{Fuel}$ in the regeneration gas decreases more quickly here.

If therefore the connecting pipe 26 between the fuel tank 18 and the fuel vapor reservoir 25 is in an intact state, then at least one of the values ascertained for the fuel concentration $C_{Fuel}$ in the regeneration gas must be greater than the reference value assigned in each case with regard to the same regeneration gas quantity $m_{tot}$. In this case, the tank venting device can at least be considered operational inasmuch as the connecting pipe between the fuel tank and the fuel vapor reservoir is intact. Furthermore, it is also possible to state that on account of the reaction of the lambda regulator 33 in response to the opening of the tank venting valve 28 the tank venting valve 28 can be considered operational.

If however the values ascertained for the fuel concentration $C_{Fuel}$ in the regeneration gas are of equal magnitude to the associated reference values or if the values for the fuel concentration $C_{Fuel}$ in the regeneration gas differ by less than a predefined tolerance amount from the reference values assigned in each case then a fault in the tank venting device is diagnosed in terms of a blockage or a leak in the connecting pipe 26 between the fuel tank 18 and the fuel vapor reservoir 25.

In order to improve the accuracy of the method, the operability of the tank venting device is assessed only in the situation when a temperature which is a measure of the temperature in the fuel tank 18 exceeds a predefined limit value. This temperature can be the ambient temperature, for example, which is measured by means of a sensor (not shown). The reason for this is the fact that an adequate evaporation of fuel vapors in the fuel tank 18 takes place only above a certain temperature. This avoids the situation whereby an incorrect diagnosis of the tank venting device occurs on account of excessively low temperatures.

The method can be improved in an advantageous manner to the effect that an assessment of the operability of the tank venting device is carried out only in the situation when the fuel tank 18 has a predefined minimum fill quantity. The reason is seen to consist in the fact that an adequate evaporation of fuel vapors takes place only above a certain minimum fill quantity of fuel. Incorrect diagnoses can also be prevented in this manner.

The method can be advantageously improved to the effect that an assessment of the operability of the tank venting device is carried out only in the situation when less than a predefined maximum fill quantity is contained in the fuel tank 18 because only a small evaporation of fuel vapors can take place when the fuel tank 18 is too full. Incorrect diagnoses can also be prevented in this manner.

The method can also be configured to the effect that a blockage or a leak in the connecting pipe 26 between the fuel tank and the fuel vapor reservoir can at least be excluded in the situation where the value initially ascertained for the fuel concentration $C_{Fuel}$ in the regeneration gas during a tank venting operation is less than the value initially ascertained during a subsequent tank venting operation for the fuel concentration $C_{Fuel}$ for the same regeneration gas quantity $m_{tot}$. This is also a clear indication that there is no blockage or leak in the connecting pipe between the fuel tank 18 and the fuel vapor reservoir 25. Advantageously, the tank venting operation and the subsequent tank venting operation are chosen such that a filling operation of the fuel tank 18 has taken place in between. As a result of the filling operation, not only does the fill quantity in the fuel tank increase but a fuel mixing process also takes place, whereby both effects result in an increased evaporation of fuel vapors.

The exemplary embodiment described above of a method for assessing the operability of a tank venting device enables additional operational checking, particularly in respect of whether the connecting pipe 26 between the fuel tank 18 and the fuel vapor reservoir 25 is blocked or has a leak. The determination of the reference values can be carried out by means of simple test runs in the laboratory.

What is claimed is:

1. A control device for an internal combustion engine comprising a tank venting device, wherein the tank venting device has a fuel vapor reservoir which is connected to a fuel tank of the internal combustion engine in such a manner that fuel vapors escaping from there are delivered to the fuel vapor reservoir, and which is connected to the internal combustion engine in such a manner that during a tank venting operation the fuel vapors contained in the fuel vapor reservoir are delivered to the internal combustion engine as regeneration gas, wherein in order to check the operability of the tank venting device, the control device is operable to:

ascertain the fuel concentration in the regeneration gas at a minimum of two different points in time during the tank venting operation, compare the values ascertained for the fuel concentration in the regeneration gas with reference values assigned in each case, wherein the reference values represent the fuel concentration in the regeneration gas for the situation in which no additional fuel vapors are delivered to the fuel vapor reservoir during the tank venting operation, and to carry out an assessment of the operability of the tank venting device is carried out on the basis of the comparison of the values ascertained for the fuel concentration in the regeneration gas with the reference values.

2. The control device according to claim 1, wherein the tank venting device is considered to be faulty if the values ascertained for the fuel concentration in the regeneration gas are of equal magnitude to the reference values assigned in each case or if the values ascertained for the fuel concentration in the regeneration gas differ by less than a predefined difference from the reference values assigned in each case.

3. The control device according to claim 1, wherein the reference values form value groups and each of the value groups is assigned to a particular initial fuel concentration in the regeneration gas.

4. The control device according to claim 3, wherein the control device is further operable to determine the value group of reference values to be used for the comparison depending on the value first ascertained during the tank venting operation for the fuel concentration in the regeneration gas.

5. The control device according to claim 3, wherein the control device is further operable to save the reference values depending on a regeneration gas quantity which is delivered during the tank venting operation of the internal combustion engine.

6. The control device according to claim 5, wherein the control device is further operable to ascertain the regeneration gas quantity which is delivered to the internal combustion engine during the tank venting operation, and to compare the values ascertained for the fuel concentration in the regeneration gas with regard to the respective regeneration gas quantity with corresponding reference values for the same respective regeneration gas quantity in each case.

7. The control device according to claim 1, wherein the assessment of the operability of the tank venting device is carried out only in the situation when a temperature which is a measure of the temperature in the fuel tank exceeds a predefined limit value.

8. The control device according to claim 1, wherein the assessment of the operability of the tank venting device is carried out only in the situation when the fuel tank has a predefined minimum fill quantity.

9. The control device according to claim 1, wherein the assessment of the operability of the tank venting device is carried out only in the situation when the fuel fill quantity in the fuel tank falls below a predefined maximum fill quantity.

10. A method for checking the operability of a tank venting device for an internal combustion engine, wherein the tank venting device has a fuel vapor reservoir which is connected to a fuel tank of the internal combustion engine in such a manner that fuel vapors escaping from there are delivered to the fuel vapor reservoir, and which is connected to the internal combustion engine in such a manner that during a tank venting operation the fuel vapors contained in the fuel vapor reservoir are delivered to the internal combustion engine as regeneration gas, the method comprising the steps of:

ascertaining the fuel concentration in the regeneration gas at a minimum of two different points in time during the tank venting operation, comparing the values ascertained for the fuel concentration in the regeneration gas with reference values assigned in each case, wherein the reference values represent the fuel concentration in the regeneration gas for the situation in which no additional fuel vapors are delivered to the fuel vapor reservoir during the tank venting operation, and carrying out an assessment of the operability of the tank venting device on the basis of the comparison of the values ascertained for the fuel concentration in the regeneration gas with the reference values.

11. The method according to claim 10, wherein the tank venting device is considered to be faulty if the values ascertained for the fuel concentration in the regeneration gas are of equal magnitude to the reference values assigned in each case or if the values ascertained for the fuel concentration in the regeneration gas differ by less than a predefined difference from the reference values assigned in each case.

12. The method according to claim 10, wherein the reference values form value groups and each of the value groups is assigned to a particular initial fuel concentration in the regeneration gas.

13. The method according to claim 12, wherein the value group of reference values to be used for the comparison is determined depending on the value first ascertained during the tank venting operation for the fuel concentration in the regeneration gas.

14. The method according to claim 12, wherein the reference values are saved depending on a regeneration gas quantity which is delivered during the tank venting operation of the internal combustion engine.

15. The method according to claim 14, wherein the regeneration gas quantity which is delivered to the internal combustion engine during the tank venting operation is ascertained, and the values ascertained for the fuel concentration in the regeneration gas with regard to the respective regeneration gas quantity are compared with corresponding reference values for the same respective regeneration gas quantity in each case.

16. The method according to claim 10, wherein the assessment of the operability of the tank venting device is carried out only in the situation when a temperature which is a measure of the temperature in the fuel tank exceeds a predefined limit value.

17. The method according to claim 10, wherein the assessment of the operability of the tank venting device is carried out only in the situation when the fuel tank has a predefined minimum fill quantity.

18. The method according to claim 10, wherein the assessment of the operability of the tank venting device is carried out only in the situation when the fuel fill quantity in the fuel tank falls below a predefined maximum fill quantity.

19. The method according to claim 10, wherein the tank venting device is considered to be at least partially operational if the fuel concentration in the regeneration gas initially ascertained during the tank venting operation is less than the fuel concentration in the regeneration gas initially ascertained during a subsequent tank venting operation with regard to the same delivered quantity of regeneration gas in each case.

20. The method according to claim 19, wherein a fuelling operation of the fuel tank has taken place between the tank venting operation and the following tank venting operation.

* * * * *